US010940519B2

(12) United States Patent
Bourriau et al.

(10) Patent No.: US 10,940,519 B2
(45) Date of Patent: Mar. 9, 2021

(54) MACHINE FOR FORMING SHEETS BY LONGITUDINAL STRETCHING

(71) Applicant: ACB, Nantes (FR)

(72) Inventors: Benoit Bourriau, Saint Philbert de Grand Lieu (FR); Julien Clergeau, La Chapelle sur Erdre (FR)

(73) Assignee: ACB, Nantes (FR)

( * ) Notice: Subject to any disclaimer, the term of this patent is extended or adjusted under 35 U.S.C. 154(b) by 168 days.

(21) Appl. No.: 15/847,239

(22) Filed: Dec. 19, 2017

(65) Prior Publication Data

US 2018/0169731 A1 Jun. 21, 2018

(30) Foreign Application Priority Data

Dec. 19, 2016 (FR) ..... 1662713

(51) Int. Cl.
*B21D 25/00* (2006.01)
*B21D 25/04* (2006.01)

(52) U.S. Cl.
CPC ..... *B21D 25/00* (2013.01); *B21D 25/04* (2013.01)

(58) Field of Classification Search
CPC ..... B21D 25/02; B21D 25/04; B21D 11/02; B21D 11/00; B21D 24/04; B21D 24/08; B21D 24/10; B21D 24/14; B25B 1/00; B25B 1/04; B25B 5/00
USPC ..... 269/32, 43, 156
See application file for complete search history.

(56) References Cited

U.S. PATENT DOCUMENTS 3,299,689 A * 1/1967 Dolney ..... B21D 25/02 72/297
3,302,437 A * 2/1967 Dolney ..... B30B 15/24 72/296
3,314,269 A * 4/1967 MacKenzie ..... B21D 25/02 72/296
3,459,025 A * 8/1969 Bath ..... B21D 11/02 72/296

(Continued)

FOREIGN PATENT DOCUMENTS

EP 1 726 377 A1 11/2006
FR 2038831 A5 * 1/1971 ..... B21D 11/02
FR 2813220 A1 * 3/2002 ..... B21D 25/02

OTHER PUBLICATIONS

Machine Translation of FR-2813220-A1 from Espacenet, Konrad, Publication Year 2002, Total Pages 11 (Year: 2019).*

(Continued)

*Primary Examiner* — Teresa M Ekiert
*Assistant Examiner* — Sarkis A Aktavoukian
(74) *Attorney, Agent, or Firm* — Nixon & Vanderhye

(57) ABSTRACT

Disclosed is a machine for forming sheets by longitudinal stretching, the machine includes: two stretch heads located on either side of a forming tool for the sheet, the stretch heads each including a line of grippers integral with a support structure which is associated with way of stretching and which is mounted on a chassis by the intermediary of a tipping axis; at least one tipping cylinder being inserted between the chassis and the support structure, in order to allow for the maneuvering in rotation of the support structure about the tipping axis; and the chassis being carried by a support frame. The stretching machine includes a unit, inserted between the support frame and the chassis, arranged to allow for an adjusting of the vertical positioning of the tipping axis.

7 Claims, 4 Drawing Sheets

(56) References Cited

U.S. PATENT DOCUMENTS

| | | | | |
|---|---|---|---|---|
| 3,595,057 | A * | 7/1971 | Mackenzie | B21D 11/02 72/302 |
| 8,943,869 | B2 * | 2/2015 | Li | B21D 25/04 72/296 |

OTHER PUBLICATIONS

Machine Translation of FR-2038831-A5 from Espacenet, Chantiers de Bretagne, Publication Year 1971, Total Pages 7 (Year: 2019).*

* cited by examiner

MACHINE FOR FORMING SHEETS BY LONGITUDINAL STRETCHING

TECHNICAL FIELD OF THE INVENTION

This invention relates to the general field of shaping or forming of sheets (in particular of metal sheets) by longitudinal stretching by means of stretch forming presses.

It more particularly relates to a machine (or press) for forming sheets by longitudinal stretching, with this machine comprising two stretch heads located on either side of a forming tool for the sheet, said stretch heads each comprising a line of grippers integral with a support structure which is associated with means of stretching and which is mounted on a chassis by the intermediary of a tipping axis, and at least one tipping cylinder being inserted between said chassis and said support structure, in order to allow for the maneuvering in rotation of said support structure about said tipping axis.

TECHNOLOGICAL BACKGROUND

Longitudinal stretching machines or presses conventionally consist of two stretch heads arranged facing one another, with each one comprising a line of grippers intended to grasp the edges of the width of the sheet that is to be conformed.

Between these two lines of grippers is arranged a forming tool on the active face of which the sheet is intended to be applied by force, in light of its shaping. The active face of this forming tool is adapted to the profile of the part that is to be obtained.

The lines of grippers facing one another are each associated with actuating cylinders in order to adapt their positioning in space and in order to implement the stretching function sought.

For example, as described in document EP-1 726 377, each line of grippers is carried by a support structure provided with stretching cylinders; and this support structure is mounted on a chassis by the intermediary of a horizontal tipping axis subjected to the action of one or of several tipping cylinders.

The two chassis that carry the lines of grippers are mounted on a support frame, one of them, at least, slidingly according to an axis of displacement parallel to the stretching axis.

In particular this document EP-1 726 377 relates to a longitudinal stretching press provided with lines of grippers that can be bent, which makes it possible to create a differential movement of traction between the central gripper and the peripheral grippers, this in such a way tends to harmonize the state of stretching over the surface of the sheet and generate a so-called stretching "with edge compensatory effect".

During the implementation of known longitudinal stretching machines, the forming tool located between the two stretch heads requires an adjustment in height, by means of suitable socket pieces, according to the sheet that is to be conformed and the stretching characteristics to be applied to it.

Although a piece of software, supplied with the machine, makes it possible to orient and design the forming tool in order to be suitably positioned with respect to the kinematics of the machine and to the forces to be supported:

already-existing tools may require in certain cases the use of additional socket pieces, and newly-designed tools may have substantial heights and masses, which generate costs.

OBJECT OF THE INVENTION

In order to overcome the aforementioned disadvantages of prior art, this invention proposes a machine for forming sheets by longitudinal stretching, said machine comprises two stretch heads located on either side of a forming tool for the sheet, said stretch heads each comprise a line of grippers integral with a support structure which is associated with means of stretching and which is mounted on a chassis by the intermediary of a tipping axis, at least one tipping cylinder being inserted between said chassis and said support structure, in order to allow for the maneuvering in rotation of said support structure about said tipping axis, and said chassis being carried by a support frame, this machine being characterized by the fact that it comprises means, inserted between said support frame and said chassis, arranged to allow for an adjusting of the vertical positioning of said tipping axis.

Such means for adjusting make it possible to adjust the height of the lines of grippers on either side of the forming tool; it is therefore possible to dispense with the presence of socket pieces systems required in the machines of prior art and as such simplify the structure of the tools. The current adjusting problems of the forming tool are passed on to the stretch heads, with the corresponding adjustments then being easier to carry out.

These particular means also confer additional possibilities for adjustment and implementation. They make it possible in particular to adjust certain angles and certain heights during the forming, as such making the operation more fluid and improving productivity.

The versatility characteristics of the machine are further improved. And, for the machines concerned, it is also possible to implement an edge compensation on the sheet during the forming operation.

According to a first embodiment, the chassis is mounted on the support frame by the intermediary of a complementary tipping axis, parallel or substantially parallel to the tipping axis, at least one complementary tipping cylinder being inserted between said chassis and said support frame in order to allow for the maneuvering in rotation of said chassis about said complementary tipping axis and as such allow for the adjusting of the vertical positioning of said tipping axis.

In the framework the tipping axis and the complementary tipping axis extend more preferably horizontally or substantially horizontally.

Furthermore said complementary tipping axis is advantageously located on the opposite side of the tipping axis with respect to the associated line of grippers.

According to an alternative embodiment the chassis is mounted on the support frame by the intermediary of means that allow for the displacement thereof with respect to said support frame parallel to itself along a vertical axis.

Said chassis then advantageously consists of a vertically sliding carriage, mounted on vertical sliders and maneuvered by one or several cylinders.

According to another particularity the support frame more preferably comprises:

a movable frame portion, which carries said means for adjusting the vertical positioning of the tipping axis, and a base frame portion, said movable frame portion being mounted mobile in translation on said base frame portion, along a direction perpendicular to the tipping axis and where applicable to the complementary tipping axis.

The base frame portion is then advantageously common to the two stretch heads and is used as a support for the forming tool.

Still according to another characteristic, the machine according to the invention comprises control means suitable for managing the displacement of the tipping cylinder or cylinders and means for adjusting the vertical positioning of the tipping axis, according to the desired spatial position of the lines of grippers.

The invention also relates to a method for implementing a machine such as defined hereinabove, consisting in managing the displacement of the tipping cylinder or cylinders and of the means for adjusting the vertical positioning of the tipping axis, according to the desired spatial position of the lines of grippers.

DETAILED DESCRIPTION OF AN EMBODIMENT

The following description with respect to the annexed drawings, given by way of non-limiting examples, will indeed provide understanding of what the invention consists of and how it can be carried out.

Figure 8:
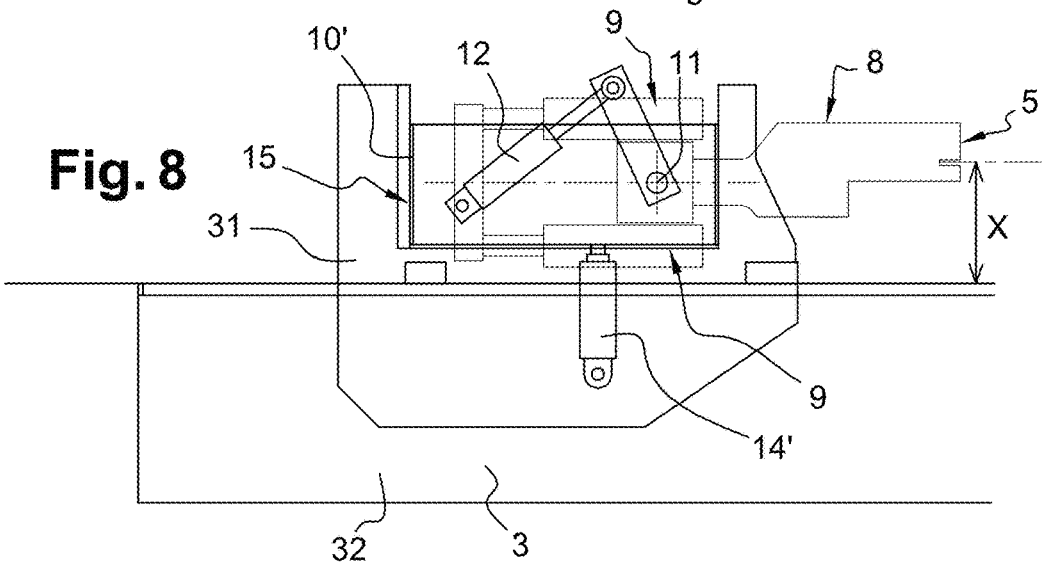
Figure 9:
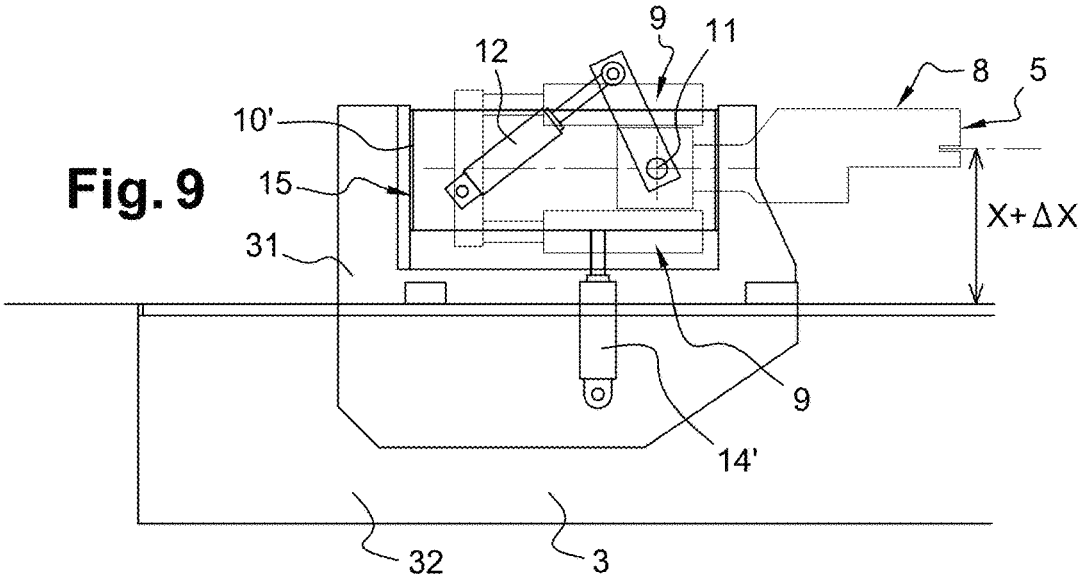

FIG. 8 diagrammatically shows an alternative embodiment of the means for adjusting the height of the tipping axis, in the form of a vertically guided carriage, here in bottom position;

FIG. 9 is a diagrammatical view similar to FIG. 8, showing the vertically guided carriage, in top position.

Figure 1:
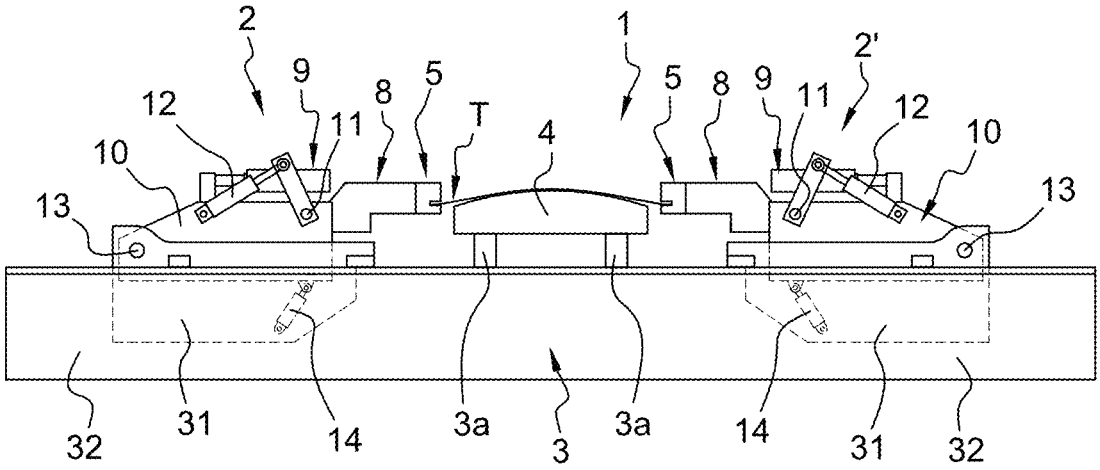
FIG. 1 is a diagrammatic side view of a machine for forming sheets by longitudinal stretching in accordance with the invention.
Figure 2:
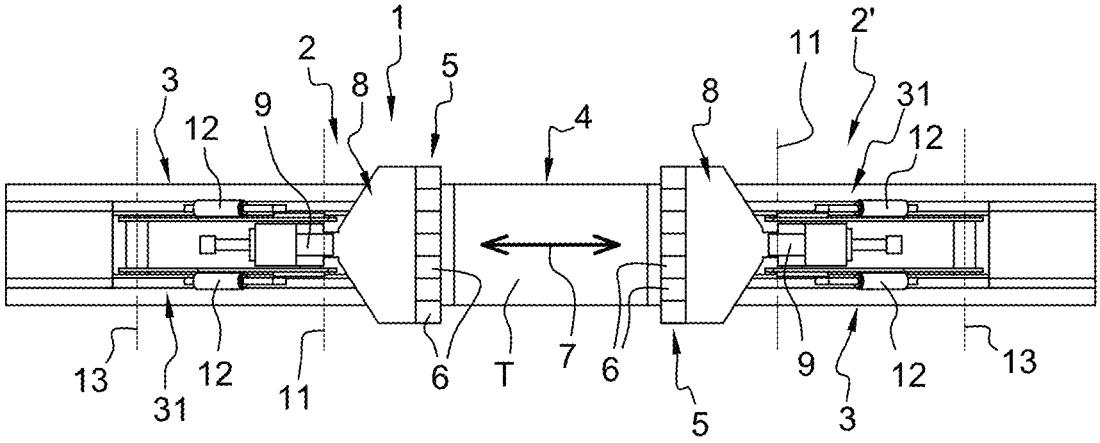
FIG. 2 is a top view of the stretching machine shown in FIG. 1.

The longitudinal stretching machine 1 in accordance with the invention, shown in the FIGS. 1 and 2, comprises two stretch heads 2, 2', here identical, mounted facing one another on a support frame 3, on either side of a forming tool 4.

The forming tool 4 is positioned and fixed on socket pieces 3*a* which in turn are fixed on the frame 3 between the two stretch heads 2, 2'; its active face is adapted according to the final shape of the pieces of sheet T that are to be obtained.

Each stretch head 2, 2' consists of a line of grippers 5 carried by mechanical means suited to provide it with the desired spatial movements.

These lines of grippers 5 have for function to clamp the edge of the width of the sheet worked, through the grasp of grippers. They each here consist of a juxtaposition from five to eleven grippers 6 (here numbering seven); and they are arranged in a plane perpendicular to the direction of stretching (marked 7 in FIG. 2), or substantially perpendicular to this direction of stretching, in order to suitably fulfill their function.

Each line of grippers 5 comprises means allowing it to be placed in a straight, curved (concave or convex), or S configuration.

In FIGS. 1 and 2, the line of grippers 5 of the two stretch heads 2, 2' is placed in a horizontal straight position; but it can also have other configurations, for example a position that is straight, curved by a certain angle with respect to the horizontal, in an S configuration, or in a convex curved position.

The configuration adopted is according to the inclination and/or the curved shape that is sought for the sheet, so that the latter can follow the profile of the edge of the tool 4 with a concern for the precision of the part carried out.

In order to fulfill their stretching function, the lines of grippers 5 are each integral with a support structure 8 subjected to the action of one or of several stretching cylinders 9.

This support structure 8 (with the line of grippers 5 and the associated stretching cylinders 9) is mounted on a chassis 10 by the intermediary of a tipping axis 11; and at least one tipping cylinder 12 is inserted between the chassis 10 and the support structure 8, in order to allow for the pivoting maneuver of this support structure 8 about the tipping axis 11.

As can be seen in FIGS. 1 and 2, in the embodiment shown, two tipping cylinders 12 provide the pivoting maneuver of the support structure 8 with respect to the chassis 10.

The tipping axis 11 extends horizontally or approximately horizontally, perpendicularly to the direction of stretching 7.

In accordance with the invention, the forming machine 1 comprises means which are inserted between the support frame 3 and the chassis 10, arranged to allow for an adjustment of the vertical positioning of the tipping axis 11 (i.e. to allow for an adjustment of the height of the tipping axis 11 and therefore of the line of grippers 5).

For this, such as shown in FIGS. 1 and 2, the chassis 10 is mounted on the support frame 3 by the intermediary of a complementary tipping axis 13, and at least one complementary tipping cylinder 14 is inserted between said chassis 10 and said support frame 3, arranged to ensure the maneuver in rotation of said chassis 10 about said complementary tipping axis 13.

The complementary tipping axis 13 extends horizontally, parallel or substantially parallel to the tipping axis 11.

As can still be seen in FIGS. 1 and 2, this complementary tipping axis 13 is located on the opposite side of the tipping axis 11 with respect to the line of grippers 5, here under the horizontal plane through which said tipping axis 11 passes.

Here, in the embodiment shown, two complementary tipping cylinders 14 provide the pivoting maneuver of the chassis 10 with respect to the support frame 3.

In the embodiment of FIGS. 1 and 2, each stretch head 2, 2' (with its chassis 10, the complementary tipping axis 13 and the associated complementary tipping cylinders 14), is carried by a movable frame portion 31, in the form of a carriage, which is mounted on a fixed base frame portion 32.

The two carriages 31 have the possibility of being displaced in translation in the direction of stretching 7 on the base frame portion 32, i.e. along a direction perpendicular to the tipping axis 11 and to the complementary tipping axis 13, this under the action of suitable means of displacement (for example cylinders, rack and pinion systems or screw-nut systems). In the embodiment of FIGS. 1 and 2 the displacement of each movable frame 31 is carried out by direct action thanks to a cylinder of which a portion is fixed on said movable frame 31 and the other on the frame base 32.

The fixed base frame portion 32 is common to the two portions of movable frame 31 and it is also used as a support for the forming tool 4 by the intermediary of socket pieces 3*a*.

The stretching machine 1 in accordance with the invention comprises control means suitable for managing the displacement of the tipping cylinders 12, of the complementary tipping cylinders 14 and of the stretching cylinders 9, according to the desired spatial position of the lines of grippers 5, this simultaneously or successively.

Figure 3:
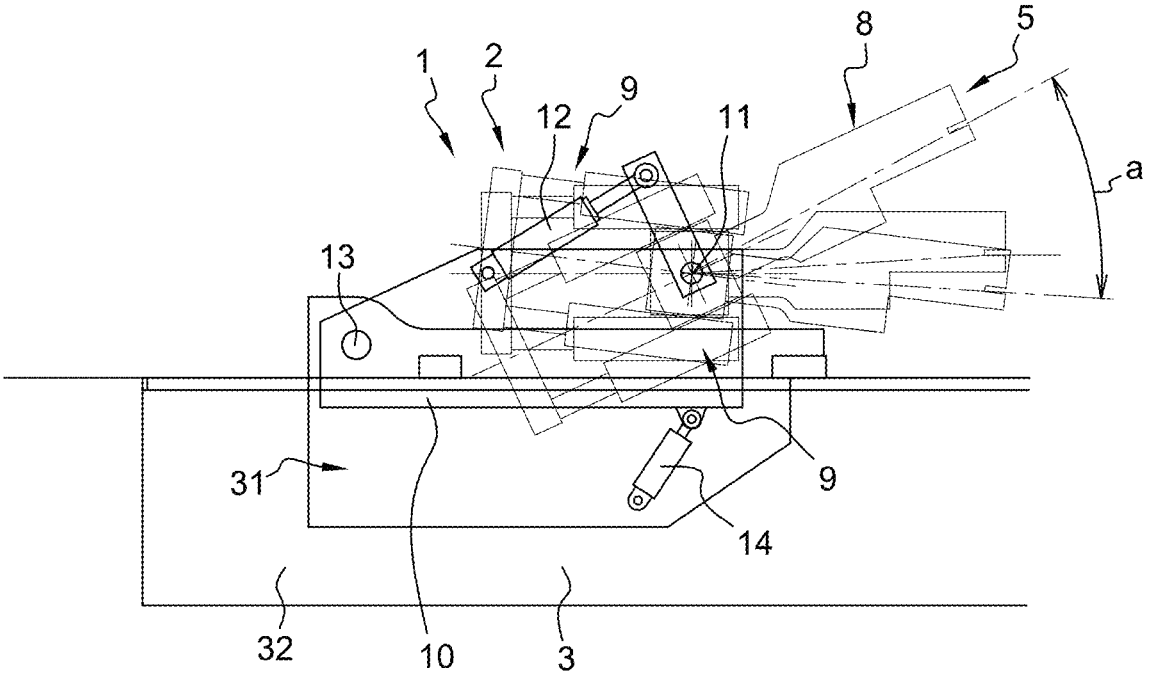
FIGS. 3 to 7 are diagrammatical side views which show different possible spatial configurations of the stretch heads of the stretching machine shown in the FIGS. 1 and 2.

As shown in FIG. 3, the tipping axis 11 of the stretch heads 2 of the stretching machine 1 in accordance with the invention can be used conventionally, by means of tipping cylinders 12, in order to pivot the line of grippers 5, for example on an angular sector a of about 30°.

Figure 4:
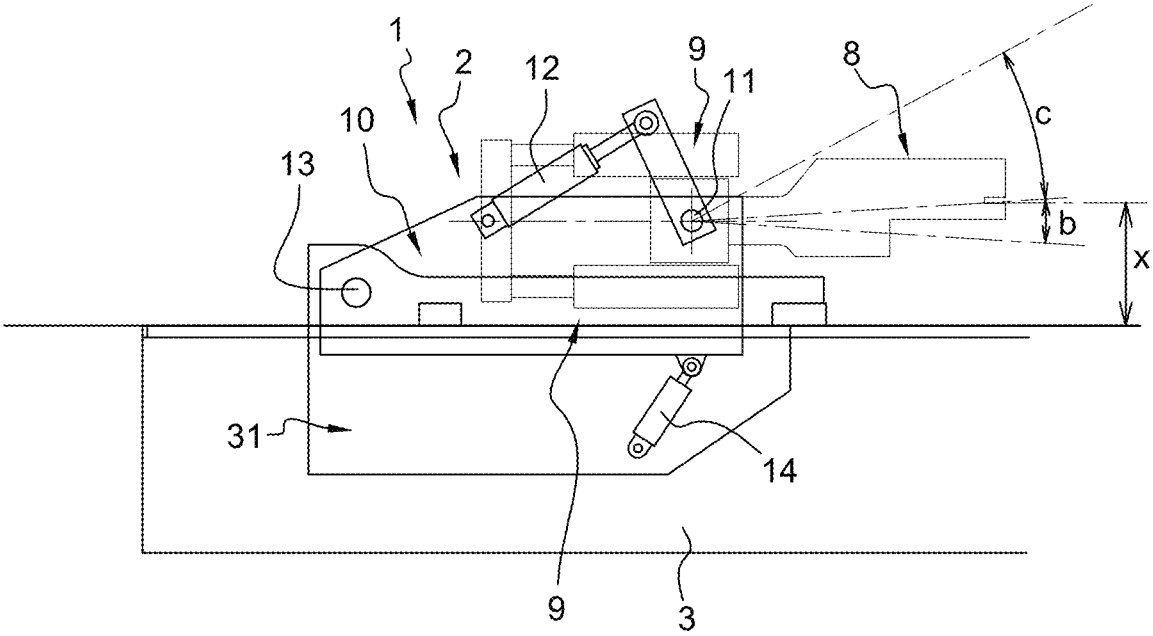

For example, as can be seen in FIG. 4, starting from a dimension of height x to the horizontal of the lines of grippers 5 (able to correspond to a bottom minimum position of the line of grippers), the stretching machine 1 can be adapted to pivot said line of grippers 5 between a negative angle b (for example about 5 to 10°) and a positive angle c (for example about 5 to) 30°.

Figure 5:
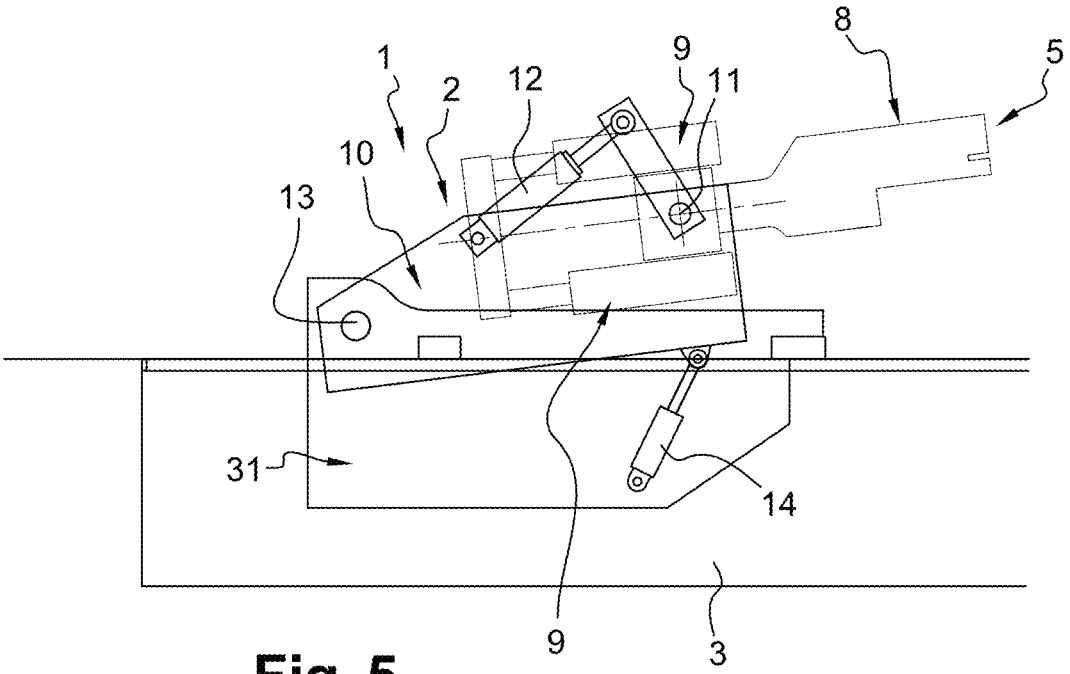
Figure 6:
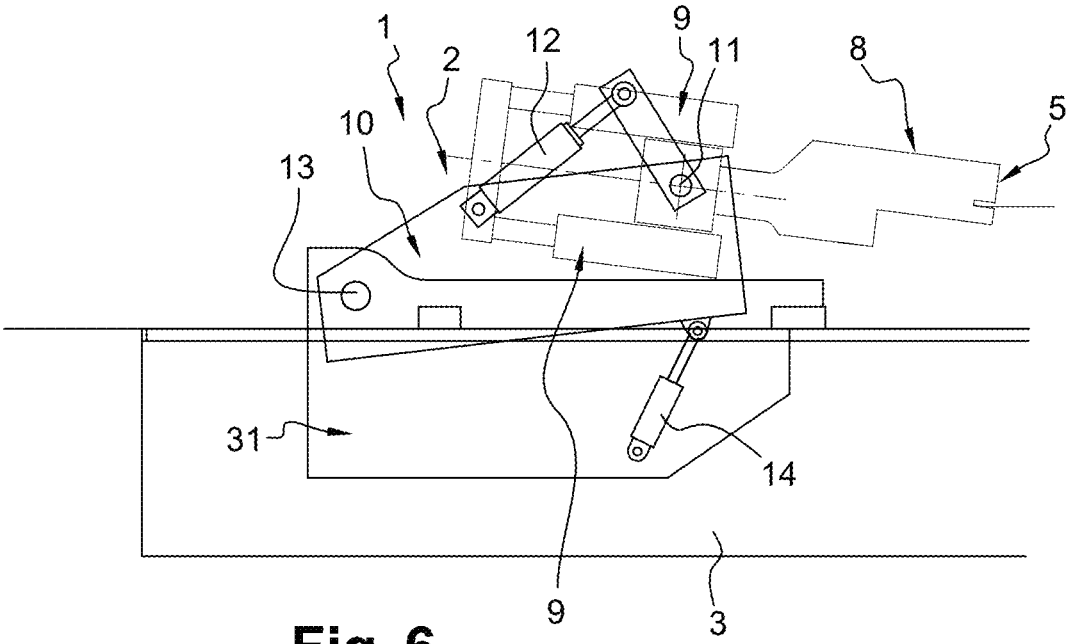

Starting from this bottom minimum position of the chassis 10, the management of the complementary tipping axis 13 by the complementary tipping cylinders 14, makes it possibility to raise the tipping axis 11, as shown in the FIGS. 5 and 6:

- in order to obtain an inclination of the chassis 10, and therefore of the line of grippers 5 (FIG. 5), or
- to carry out an edge compensation on the sheet (FIG. 6).

Figure 7:
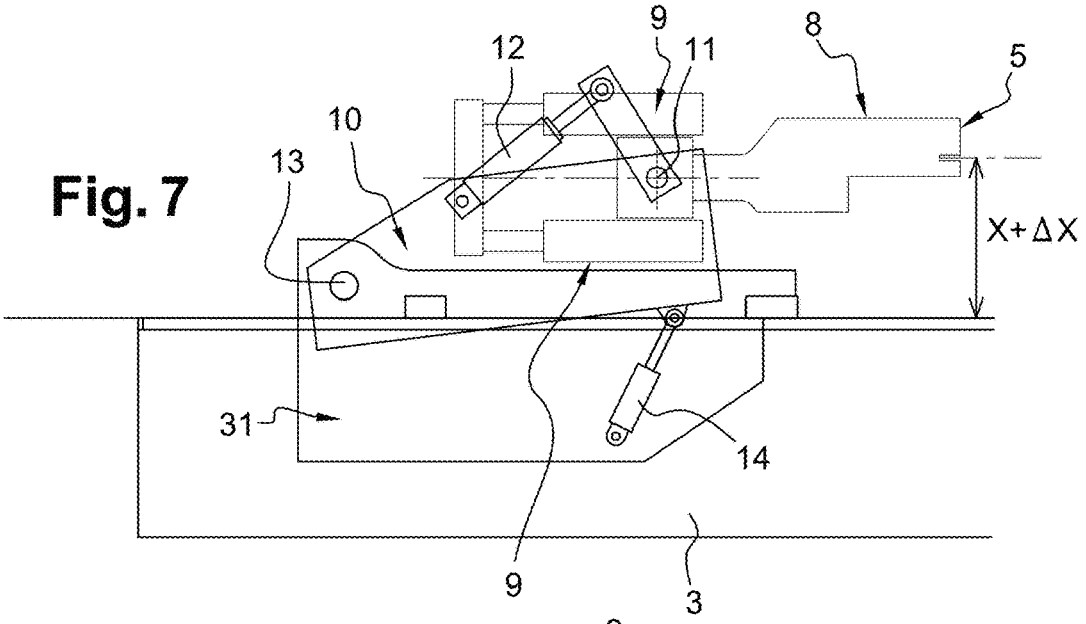

It is also possible to obtain a top maximum horizontal position of the line of grippers 5, such as shown in FIG. 7 (with the dimension of height x+Δ x of the line of grippers 5 in FIG. 7 being greater than the cote x of FIG. 4).

Any other combined management of the tipping axis 11 and of the complementary tipping axis 13 can be implemented.

Generally:

- the complementary tipping cylinders 14 make it possible to raise or lower the tipping axis 11 in order to adjust the level of the lines of grippers 5, and allow for the combined or uncombined implementation of an edge compensation operation;
- the tipping cylinders 12 allow for the tipping of the supports of the lines of grippers 5 according to the stretching sought, and make it possible to offset the action of the complementary tipping cylinders 14;
- the stretching cylinders 9 are used to stretch the sheet and/or to offset the effect of rotation of the supports of the lines of grippers (so as in particular to retain the distance between the two lines of grippers).

According to an alternative embodiment shown in FIGS. 8 and 9, the chassis bearing the support structure 8 is mounted on the support frame 3 by the intermediary of means that allow for the displacement thereof parallel to itself along a vertical axis.

These means of displacement then advantageously consist of a chassis 10' in the form of a carriage sliding vertically along sliders 15 integral with the movable frame 31, and actuated by at least one hydraulic cylinder 14'. For example two hydraulic cylinders 14' are placed on either side of the carriage 10'. The cylinder or cylinders 14' can be placed at the bottom or at the top of the movable frame 31.

The raising/lowering function of the support structure 8 and therefore of the line of grippers 5 is carried out by acting directly on the tipping axis 11 placed on the sliding chassis 10'. The dimension of height x+Δ x of the line of grippers 5 in FIG. 9 is greater than the dimension x in FIG. 8.

For this embodiment also, control means are suitable for managing the displacement of the tipping cylinders 12 and of the carriage with vertical guiding, according to the desired spatial position of the lines of grippers 5, this simultaneously or successively.

The longitudinal stretching machine in accordance with the invention has the following advantages:

- avoids the presence of socket pieces that can be adjusted in height on the forming tool (simplified tools and implementation),
- increases the possibility of adjustment,
- makes it possible to conform the sheet as close as possible to the tool,
- better versatility for forming,
- possibility of edge compensation during the forming,
- possibility of adjusting the angles and the heights during forming.

The invention claimed is:

1. A machine for forming sheets by longitudinal stretching, said machine (1) comprising:

- a support frame (3);
- a forming tool (4) for the sheet;
- a first chassis (10) and a second chassis (10) mounted on the support frame (3) respectively on first and second sides of the forming tool (4);
- a first stretching cylinder (9) and a second stretching cylinder (9);
- first and second support structures (8);
- a first tipping axis (11) and a second tipping axis (11) associated respectively with each of the first and second support structures (8), a vertical position of each of the first tipping axis and the second tipping axis being vertically adjustable;
- a first tipping cylinder (12) inserted between the first chassis (10) and the first support structure (8), the first support structure (8) being mounted at said first tipping cylinder (12) to thereby allow for a pivoting maneuver of said first support structure (8) about said first tipping axis (11);
- a second tipping cylinder (12) inserted between the second chassis and the second support structure (8), the second support structure (8) being mounted at said second tipping cylinder (12) to thereby allow for a pivoting maneuver of said second support structure (8) about said second tipping axis (11);
- a first stretch head (2) and a second stretch head (2') located respectively on the first and second sides of the forming tool (4),
- said first and second stretch heads (2, 2') comprising respectively a first line of grippers (5) integral with the first support structure (8) and a second line of grippers (5) integral with the second support structure (8),
- the first support structure (8), the first stretching cylinder (9), and the first line of grippers (5) being mounted at the first tipping axis (11) on the first chassis (10),
- the second support structure (8), the second stretching cylinder (9), and the second line of grippers (5) being mounted at the second tipping axis (11) on the second chassis (10),
- said first chassis (10) and said support frame (3) being mounted together at a third tipping axis (13);
- a third tipping cylinder (14) being inserted between said first chassis (10) and said support frame (3),
- the third tipping axis (13) being parallel to the first tipping axis (11), the third tipping axis (13) and the third tipping cylinder (14) allowing for a maneuver in rotation of said first chassis (10) about said third tipping axis (13) to thereby vertically adjust the vertical position of said first tipping axis (11), said second chassis (10) and said support frame (3) being mounted together at a fourth tipping axis (13); and a fourth tipping cylinder (14) being inserted between said second chassis (10) and said support frame (3), the fourth tipping axis (13) being parallel to the second tipping axis (11), the fourth tipping axis (13) and the fourth tipping cylinder (14) allowing for a maneuver in rotation of said second chassis (10) about said fourth tipping axis (13) to thereby vertically adjust the vertical position of said second tipping axis (11).

2. The machine according to claim 1, wherein both said first tipping axis (11) and said third tipping axis (13) extend horizontally.

3. The machine according to claim 1, wherein the third tipping axis (13) is located on a first side of the first tipping axis (11) and the first line of grippers (5) is located on an opposite, second side of the first tipping axis (11), wherein the fourth tipping axis (13) is located on a first side of the second tipping axis (11) and the second line of grippers (5) is located on an opposite, second side of the second tipping axis (11).

4. The machine according to claim 1, wherein said support frame (3) comprises:

a first movable frame portion (31), that carries said first vertical positioning mechanism, a second movable frame portion (31), that carries said second vertical positioning mechanism, a base frame portion (32), said first movable frame portion (31) and said second movable frame portion (31) being mounted mobile in translation on said base frame portion (32), along a direction perpendicular to said first tipping axis (11) and to said third tipping axis (13).

5. The machine according to claim 4, wherein the base frame portion (32) is common to the first and second stretch heads (2, 2') and supports the forming tool (4).

6. The machine according to claim 1, wherein displacement of said first tipping cylinder (12) and of at least one element of said first vertical positioning mechanism adjusts the vertical position of the first tipping axis (11), the adjustment of the vertical position of the first tipping axis (11) changing a spatial position of the first line of grippers (5), and wherein displacement of said second tipping cylinder (12) and of at least one element of said second vertical positioning mechanism adjusts the vertical position of the second tipping axis (11), the adjustment of the vertical position of the second tipping axis (11) changing a spatial position of the second line of grippers (5).

7. A method for operating the machine according to claim 1, wherein the method comprises:

controlling the displacement of said first tipping cylinder (12) and of said third tipping cylinder (14) to adjust the vertical position of the first tipping axis (11) according to a desired spatial position of said first line of grippers (5); and controlling the displacement of said second tipping cylinder (12) and of said fourth tipping cylinder (14) to adjust the vertical position of the second tipping axis (11) according to a desired spatial position of said second line of grippers (5).

* * * * *